United States Patent [19]

Jankot

[11] Patent Number: 4,536,129

[45] Date of Patent: Aug. 20, 1985

[54] TURBINE BLADE WITH DISK RIM SHIELD

[75] Inventor: Alan L. Jankot, South Glastonbury, Conn.

[73] Assignee: United Technologies Corporation, Hartford, Conn.

[21] Appl. No.: 621,275

[22] Filed: Jun. 15, 1984

[51] Int. Cl.[3] ..... F01D 5/08

[52] U.S. Cl. ..... 416/95; 416/193 A

[58] Field of Search ..... 416/193 A, 95, 198 A, 416/145, 96–97

[56] References Cited

U.S. PATENT DOCUMENTS

| | | | |
|---|---|---|---|
| 2,656,147 | 10/1953 | Brownhill et al. | 416/198 A X |
| 2,660,400 | 11/1953 | Griffith | 419/193 A X |
| 2,858,103 | 10/1958 | Waugh | 416/193 A X |
| 2,915,279 | 12/1959 | Chamberlin | 416/193 A X |
| 2,920,865 | 1/1960 | Lombard | 253/39.15 |
| 2,957,675 | 10/1960 | Mason et al. | 253/77 |
| 3,066,910 | 12/1962 | Bluck | 416/193 A X |
| 3,266,771 | 8/1966 | Morley | 253/77 |
| 3,295,825 | 1/1967 | Hall | 416/193 A X |
| 3,661,475 | 5/1972 | Anderson et al. | 416/219 |
| 3,719,431 | 3/1973 | Steele et al. | 416/193 A X |
| 3,791,758 | 2/1974 | Jenkinson | 416/193 A X |
| 3,813,185 | 5/1974 | Bouiller et al. | 416/198 |
| 3,832,090 | 8/1974 | Matto | 416/193 A X |
| 3,834,831 | 9/1974 | Mitchell | 416/95 |
| 3,922,109 | 11/1975 | Hagen | 416/213 |
| 4,084,922 | 4/1978 | Glenn | 416/193 A X |
| 4,093,399 | 6/1978 | Glenn | 416/193 A X |
| 4,142,836 | 3/1979 | Glenn | 416/193 A |
| 4,178,129 | 12/1979 | Jenkinson | 416/193 A X |
| 4,182,598 | 1/1980 | Nelson | 416/193 |
| 4,265,594 | 5/1981 | Eggmann | 416/193 A |

FOREIGN PATENT DOCUMENTS

| | | | |
|---|---|---|---|
| 1300351 | 7/1969 | Fed. Rep. of Germany . | |
| 2816791 | 11/1978 | Fed. Rep. of Germany | 416/193 A |
| 69423 | 6/1981 | Japan | 416/193 A |
| 72222 | 6/1981 | Japan | 416/193 A |
| 809268 | 2/1959 | United Kingdom | 416/193 A |

*Primary Examiner*—Everette A. Powell, Jr.

*Attorney, Agent, or Firm*—Charles A. Warren

[57] ABSTRACT

In a gas turbine engine the turbine blade has protective flanges closely overlying the rim of the rotor to shield the rotor from the hot power gases and to form a path for cooling air. These flanges are spaced radially inward from the flanges on the blade that define the inner wall of the gas path through the turbine.

5 Claims, 2 Drawing Figures

TURBINE BLADE WITH DISK RIM SHIELD

DESCRIPTION

1. Technical Field

The turbine blade in a gas turbine engine carries protective flanges directly adjacent to the disk rim to shield it from hot gases leaking between the blade platforms that form the inner wall of the gas path.

2. Background Art

Many attempts have been made to shield the periphery of the turbine disk from the hot propulsive gases passing through the turbine, but invariably an extra part has been utilized in directing the hot gas or guiding the cooling gas over the rim. For example, Mitchell, U.S. Pat. No. 3,834,831, supplies cooling air to a cavity in the blade by using a tube positioned in the blade. A cooling tube is also positioned between the shanks of adjacent blades. This is an extraneous piece that increases the complication and cost of the assembled disk and blades and the malfunctioning of one of the tubes could result in turbine failure. Morley, U.S. Pat. No. 3,266,771, places an extraneous member between the blades inwardly of the blade platforms, but again the extra parts increase the complexity of the assembled disk and blades. Further than that, the Morley patent is concerned with blade damping and not with any mechanism for shielding the rim of the disk from hot gases.

DISCLOSURE OF INVENTION

The principal feature of the present invention is the positioning of flanges on the blade shank in spaced relation to the blade platform and in such a position that they closely overlie the disk rim between the root receiving recesses with these flanges on adjacent blades extending toward one another almost into contact. Thus when disk and blades are assembled these flanges form an almost complete protection to the periphery of the disk so that any hot gas escaping from the gas path by flowing between the adjacent blade platforms will not contact the disk. With these flanges closely spaced from the disk rim a space is allowed for the flow of cooling air to pass axially over the disk between the rim and the flanges for effective cooling of the disk rim. With this cooling air at a higher pressure than the hot gas external of these flanges the flow of cooling air between the rim and the closely adjacent flanges will prevent entry of the hot gas into the cooling space.

In a first stage turbine the upstream side of the space between the platforms and these flanges may be closed and the downstream side may be open for the escape of this leakage hot gas from this space.

According to the invention the opposed flanges at the base of the blade shank and closely spaced from the end of the disk define a cooling air space for axial flow of air supplied to the rim for this purpose and additionally form a shield for the rim to prevent the hot gases leaking past the blade platforms from contacting the rim either directly or indirectly. The flanges also shield the portions of the rim between the blade root receiving slots from heat radiation from the shanks or platform of the blade.

Other features and advantages will be apparent from the specification and claims and from the accompanying drawings which illustrate an embodiment of the invention.

BEST MODE FOR CARRYING OUT THE INVENTION

Figure 1:
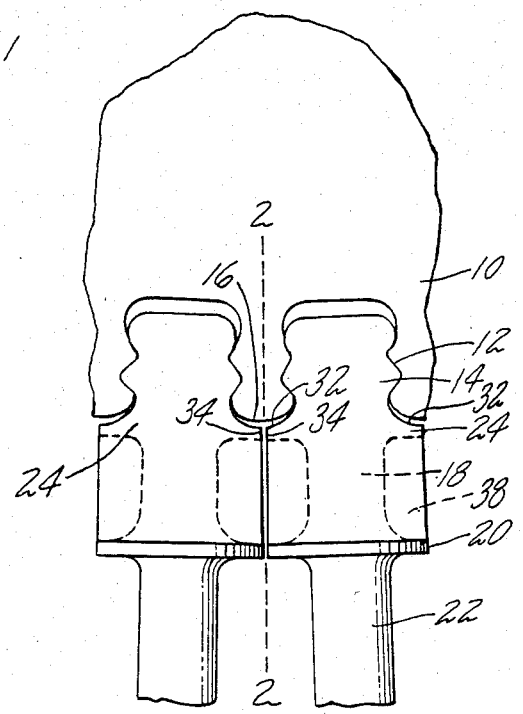
FIG. 1 is a side elevation of a portion of the disk and blades as seen from the rear.
Figure 2:
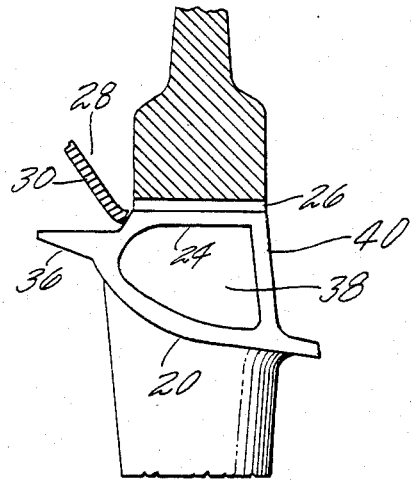
FIG. 2 is a sectional view along the line 2—2 of FIG. 1.

The rotor disk 10 has slots or grooves 12 in its periphery to receive the roots 14 of the blade leaving between the slots 12 a rim portion 16 of the disk. The slots and blade roots are of modified fir tree configuration to retain the blades in the disk. Each blade has a strut 18 extending from the root to the blade platform 20 and beyond the platform is the airfoil portion 22 of the blade over which the hot power gas flows, the inner wall of the gas path being defined in part by the platforms. These platforms are in circumferential alignment and the opposite edges of the platforms are relatively close to one another, being spaced only to permit the necessary thermal extention during operation and also permitting such vibration as may occur in the individual blades. At the inner end of the strut directly adjacent to the rim of the disk are opposed flanges 24 forming a structure comparable to the platform but spaced inwardly of the platform to be located closely adjacent to the rim of the disk as shown. The spacing of the flanges from the rim is such as to provide a small axial clearance passage 26 for the flow of cooling air therethrough. This cooling air may be supplied to the space 28 on the upstream side of the disk and guided to the passage 26 by a guide ring 30 at the face of the disk.

The underside of these flanges is preferably curved as at 32 to approximate the curvature of the rim in this area and the opposed edges 34 of the flanges 24 on adjacent disks are closely spaced from one another to minimize leakage of cooling air from the space 26. Obviously the more of the disk rim that is shielded by these flanges the less radiation from the platforms can reach the rim. These flanges are substantially equal in circumferential dimension to the platforms spaced outwardly therefrom, differing in dimension only enough to compensate for the radial positioning of the turbine blades in the disk.

The arrangement shown is for a first stage turbine blade and the platform on each blade curves inwardly at the upstream end to be integral with the forward edges of the flanges. In this way the curved platform guides the power gas into the gas path around the airfoil portions of the blade. The leading edges of the flanges may be extended forwardly as at 36 to form an extention of the inner wall of the gas path to cooperate with a stationary wall of the turbine structure.

The chamber 38 defined between adjacent shanks and the platforms 20 and the flanges 24 may be cast into the blade structures when it is being made and in this event there may be a rear wall 40 extending between the platform and flange to form an essential closed chamber. The clearance between the walls on adjacent blades is similar to that between adjacent platforms and this limits the escape of gases from within the chamber during operation.

I claim:

1. A turbine blade having an airfoil section, a platform at the inner end of the airfoil section, a shank extending from the platform from the side opposite to the airfoil section, opposed flanges extending outwardly in substantially parallel relation to the platform at the end of the shank, and a blade root immediately at the end of the shank on the other side of the flanges, said opposed flanges being of such a dimension that when the blade is assembled on the disk, the flanges of adjacent blades will be closely adjacent to one another and closely overlying and in spaced relation to the rim of the disk to form an axial air passage at said rim.

2. A turbine blade as in claim 1 in which the flanges and the platform are substantially the same dimension circumferentially allowing only for a radial positioning of adjacent blades in the disk.

3. The combination with a disk having spaced slots in the periphery to receive the blade roots with a portion of the rim located between adjacent slots of turbine blades having roots positioned in said slots, each blade having flanges extending over the rim portions at the outer end of the root and closely overlying the rim portions of the disk in closely spaced relation thereto to form an axial cooling air passage therebetween, struts extending outwardly from the roots on the sides of the flanges opposite to the roots, platforms at the end of the struts, and airfoil portions extending outwardly from said platforms.

4. The combination as in claim 3 in which the flanges are arranged so that opposite edges of the flanges on adjacent blades are closely spaced apart to minimize leakage of gas therebetween.

5. The combination as in claim 3 in which the undersides of the flanges are curved to conform to the curvature of the rim of the disk at the points adjacent to said flanges.

* * * * *